US006666038B1

(12) United States Patent
Hynes

(10) Patent No.: US 6,666,038 B1
(45) Date of Patent: Dec. 23, 2003

(54) AIR CONDITIONING SYSTEM INCLUDING LIQUID WASHDOWN DISPENSER AND RELATED METHODS

(76) Inventor: Richard A. Hynes, 603 Atlantic St., Melbourne Beach, FL (US) 32951

( * ) Notice: Subject to any disclaimer, the term of this patent is extended or adjusted under 35 U.S.C. 154(b) by 0 days.

(21) Appl. No.: 10/242,875

(22) Filed: Sep. 13, 2002

(51) Int. Cl.[7] ..... F28D 3/00; F28D 5/00
(52) U.S. Cl. ..... 62/171; 62/303
(58) Field of Search ..... 62/171, 303, 279, 62/280, 183, 231; 165/95; 134/18, 34, 57 R

(56) References Cited

U.S. PATENT DOCUMENTS

| | | | | | |
|---|---|---|---|---|---|
| 3,375,981 | A | | 4/1968 | Keck | 239/553.3 |
| RE31,792 | E | | 1/1985 | Colomer | 134/181 |
| 4,566,890 | A | * | 1/1986 | Hostler et al. | 65/12 |
| 4,666,531 | A | * | 5/1987 | Minard | 134/26 |
| 4,884,416 | A | * | 12/1989 | Hwang | 62/303 |
| 4,905,900 | A | | 3/1990 | Scharton et al. | 239/99 |
| 5,186,240 | A | * | 2/1993 | Kennon et al. | 165/95 |
| 5,211,028 | A | * | 5/1993 | Remo | 62/303 |
| 5,279,357 | A | * | 1/1994 | Kennon et al. | 165/95 |
| 5,311,747 | A | | 5/1994 | Pringle et al. | 62/183 |
| 5,362,266 | A | | 11/1994 | Brogdon | 440/88 |
| 5,605,052 | A | * | 2/1997 | Middleton et al. | 62/171 |
| 5,611,487 | A | | 3/1997 | Hood | 239/172 |
| 5,879,466 | A | * | 3/1999 | Creger et al. | 134/18 |
| 6,182,741 | B1 | | 2/2001 | Yoshii et al. | 165/41 |
| 6,318,108 | B1 | * | 11/2001 | Holstein et al. | 62/279 |
| 2002/0124586 | A1 | * | 9/2002 | Trulaske | 62/231 |

FOREIGN PATENT DOCUMENTS

| | | | |
|---|---|---|---|
| JP | 63-150540 | 6/1988 | F24F/3/16 |

* cited by examiner

*Primary Examiner*—Marc Norman
(74) *Attorney, Agent, or Firm*—Allen, Dyer, Doppelt, Milbrath & Gilchrist, P.A.

(57) ABSTRACT

An air conditioning system may include an indoor heat exchanger to be positioned within a building including a refrigerant for exchanging heat with air inside the building, and a outdoor unit to be positioned outside of the building. The outdoor unit may include a housing and an outdoor heat exchanger carried by the housing. The outdoor heat exchanger may be connected in fluid communication with the indoor heat exchanger for exchanging heat between air outside the building and the refrigerant, which may be circulated by a compressor. The system may also include a liquid washdown dispenser carried by the housing adjacent the outdoor heat exchanger. In particular, the liquid washdown dispenser may be connected to a liquid dispensing source for dispensing liquid (e.g., fresh water) to wash down the outdoor heat exchanger. A controller may also be included for controlling liquid flow to the liquid washdown dispenser.

20 Claims, 2 Drawing Sheets

AIR CONDITIONING SYSTEM INCLUDING LIQUID WASHDOWN DISPENSER AND RELATED METHODS

FIELD OF THE INVENTION

The present invention relates to the field of air conditioning systems, and, more particularly, to a system and method for removing salt, dirt, etc., from air conditioning components.

BACKGROUND OF THE INVENTION

Air conditioners have long been used to provide comfortable air temperatures inside buildings. One type of air conditioning system which enjoys widespread use is the central heating and air conditioning system. Such systems typically include an indoor unit inside a building including a heat exchanger which transfers heat from air in the building to a refrigerant inside the heat exchanger. The refrigerant is then pumped outside the building by a compressor to an outdoor heat exchanger located in an outdoor unit where the heat is then transferred to the outside air.

Central heating/air conditioning systems can also be operated in a reverse manner (i.e., as heat pumps) during colder months to bring heat from the outside air into the building. While heat pumps generally cannot provide large amounts of heat as efficiently as a furnace, for example, they typically are able to provide adequate heat in regions that have fairly mild winters.

As such, central heating/air conditioning systems are particularly well suited for warmer climates, including coastal environments. In such environments the high quantity of corrosive salts in the air often causes various components of air conditioning systems to corrode, particularly the outdoor unit components which are continuously exposed to salt air. For example, the copper tubing used to make heat exchanger assemblies is particularly susceptible to corrosion from salts, as may also be certain parts of the fan used to blow outside air through the outdoor heat exchanger. Moreover, in other environments where coils, fans, etc. tend to have a large amount of dirt or other debris accumulate thereon, this may also tend to decrease component lifespan in addition to reducing system performance.

Some prior art systems have attempted to address the effects of corrosive particles on certain air conditioning system components. By way of example, U.S. Pat. No. 6,182,741 to Yoshii et al. is directed to an air conditioner for preventing corrosion of an evaporator heat exchanger. The air conditioner includes a case and an evaporator therein having a core portion and a lower tank at a bottom of the core portion. The case has a recess portion at an upstream air side of the evaporator, and a covering wall extends upwardly from the bottom of the recess portion to cover only the lower tank at an immediately upstream air side. When air passes through the evaporator, corrosive substances in the air collide with the evaporator and fall in the recess portion. As such, the corrosive substances do not directly adhere to the lower tank of the evaporator, which reduces evaporator corrosion.

A somewhat similar air conditioner is described in Japanese Patent No. 63-150540 to Yasuhiro. This air conditioner includes a condensation chamber which is filled with humidified air to remove salt particles from air being taken into the system. This is done to reduce the accumulation of such particles on a filter, and thus premature pressure loss. Moreover, the reduction in salt particles in the air also helps to prevent corrosion of a blower downstream from the condensation chamber.

While the above systems may be helpful in reducing corrosion of central air conditioning system components inside a building (i.e., the evaporator and blower), they provide no such protection for outdoor components. As such, apart from persistent manual cleanings, there has heretofore been no convenient way to reduce the accumulation of corrosive or other particles on outdoor air conditioning system components. Thus, such components require replacement on a more frequent basis, and system performance may suffer, when used in corrosive or dirty environments.

SUMMARY OF THE INVENTION

In view of the foregoing background, it is therefore an object of the present invention to provide an air conditioning system and associated methods which reduce the accumulation of salts, dirt and other contaminants on outdoor system components which may lead to system performance degradation and/or premature component failure.

This and other objects, features, and advantages in accordance with the present invention are provided by an air conditioning system including an indoor heat exchanger to be positioned within a building and including a refrigerant for exchanging heat with air inside the building, and an outdoor unit to be positioned outside of the building. The outdoor unit may include a housing and an outdoor heat exchanger carried by the housing. Further, the outdoor heat exchanger may be connected in fluid communication with the indoor heat exchanger for exchanging heat between the refrigerant and air outside the building. The air conditioning system may also include a compressor for circulating the refrigerant between the indoor heat exchanger and the outdoor heat exchanger.

Additionally, the system may further include a liquid washdown dispenser carried by the housing adjacent the outdoor heat exchanger. In particular, the liquid washdown dispenser may be connected to a liquid dispensing source for dispensing liquid (e.g., fresh water) to wash down the outdoor heat exchanger. Further, a controller may also be included for controlling liquid flow to the liquid washdown dispenser. Accordingly, the controller and liquid washdown dispenser advantageously cooperate to remove potentially corrosive or harmful particles from the outdoor heat exchanger before significant component or system performance degradation results.

More particularly, the outdoor unit may also include a fan carried by the housing for circulating outside air through the outdoor heat exchanger, and the liquid washdown dispenser may also dispense liquid to wash down the fan. The outdoor unit may also be switchable between on and off states, and the controller may prohibit liquid flow to the liquid washdown dispenser when the outdoor unit is in the on state. As such, the liquid will not be sprayed outside of the outdoor unit by the fan, for example.

Furthermore, the controller may also include a timer for periodically causing the liquid flow to be turned on and off. Thus, the timer may be set to provide liquid dispensing at desired intervals and for a predetermined duration so that wash downs are performed frequently enough to adequately reduce corrosion, yet while not wasting liquid/fresh water. In particular, the controller may further include a valve connecting the liquid washdown dispenser to the liquid dispensing source, and a solenoid connected between the timer and the valve.

The liquid washdown dispenser may include a plurality of nozzles adjacent the outdoor heat exchanger and tubing connecting the nozzles to the liquid dispensing source. In addition, the housing may have openings therein to permit air flow, and the outdoor heat exchanger may be positioned adjacent the at least one side.

A method aspect of the invention is for retrofitting an outdoor unit of an air conditioning system to be positioned outside of a building, such as the one described briefly above. The method may include mounting a liquid washdown dispenser in the housing adjacent the outdoor heat exchanger, and connecting the liquid washdown dispenser to a liquid dispensing source for dispensing liquid to wash down the outdoor heat exchanger. In addition, the method may also include connecting a controller to the liquid dispensing source for controlling liquid flow to the liquid washdown dispenser.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
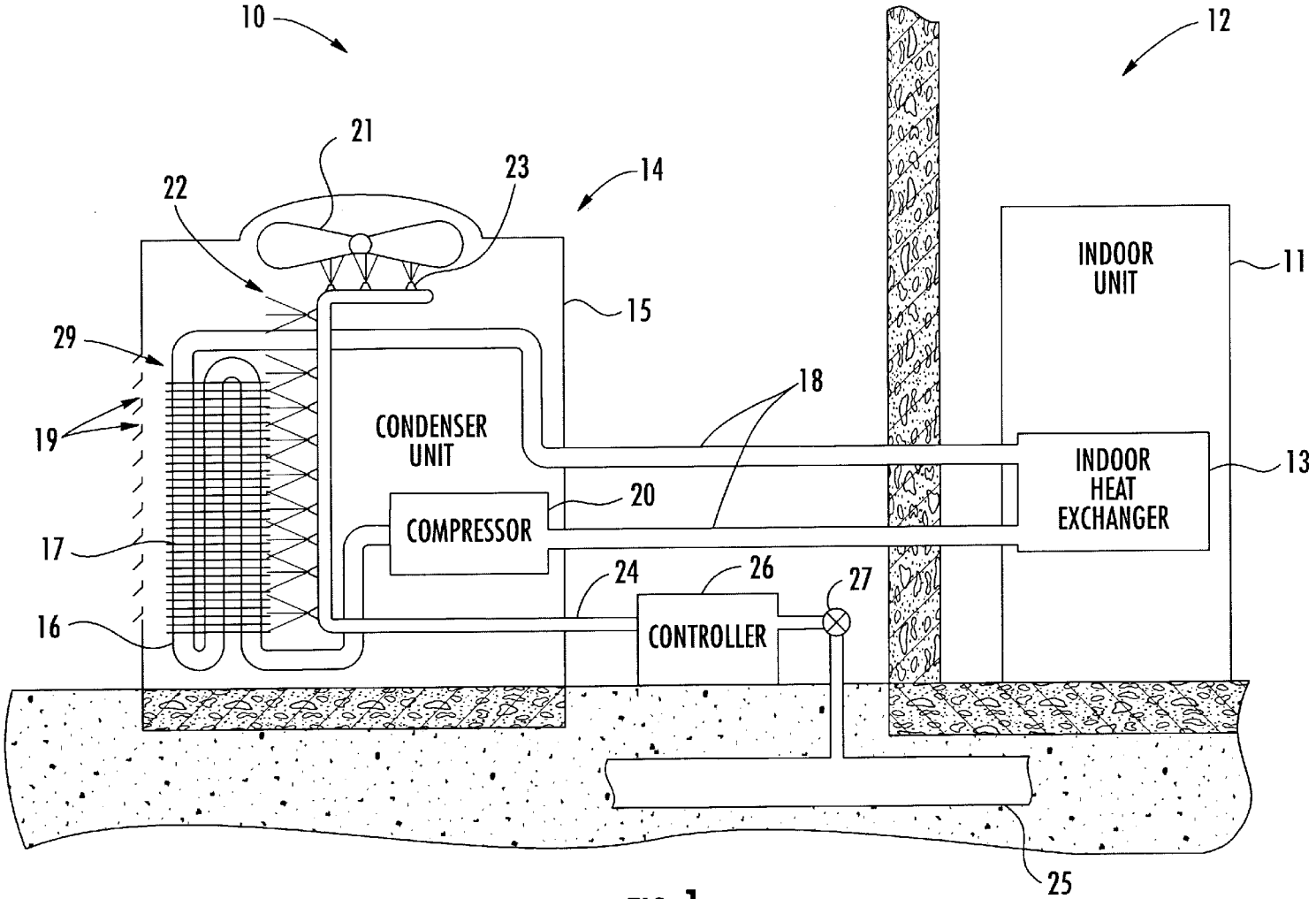
FIG. 1 is a schematic block diagram of an air conditioning system in accordance with the present invention.
Figure 2:
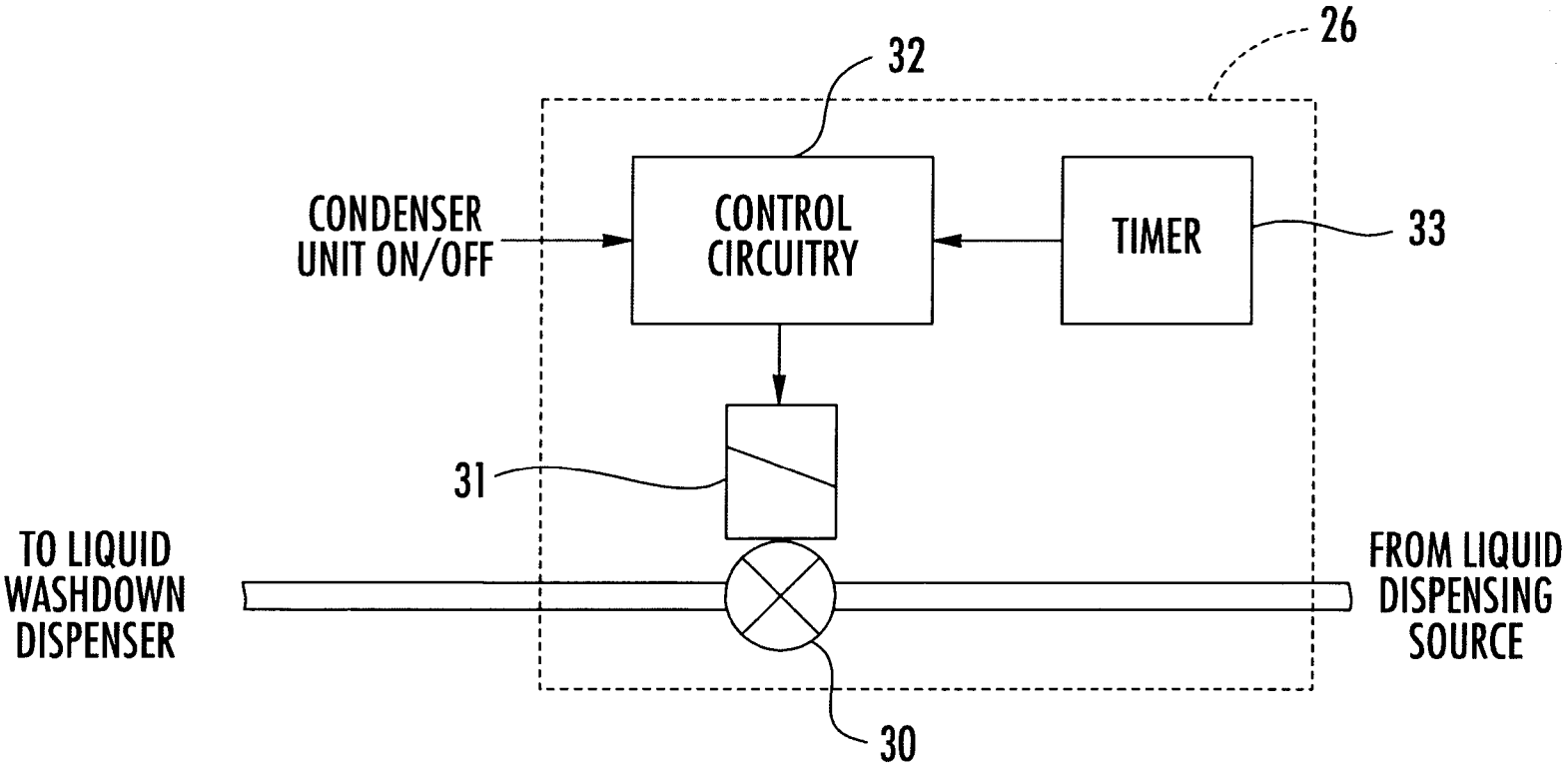
FIG. 2 is a schematic block diagram illustrating in greater detail the controller of FIG. 1.

Turning now to FIGS. 1–2, an air conditioning system 10 in accordance with the present invention illustratively includes an indoor unit 11 that is positioned within a building 12. As previously described above, the indoor unit 11 includes an indoor heat exchanger 13 which exchanges heat between air in the building 12 and a refrigerant being circulated in the indoor heat exchanger. That is, a fan or blower (not shown) blows air from within the building 12 through the indoor heat exchanger 13, which is typically constructed of copper tubing configured in coils which have metal (e.g., aluminum) fins mounted thereon to increase the amount of surface area over which heat exchange takes place.

Thus, when cooling within the building 12 is required, warm air from within the building is blown across the indoor heat exchanger 13, which draws heat from the air into the refrigerant. When heating is required, the air conditioning system 10 is operated in reverse as a heat pump in that the refrigerant circulating through the indoor heat exchanger 13 is warmer than the indoor air, and thus heat is draw from the refrigerant to heat the indoor air. The air conditioning system 10 may include a reversing valve (not shown) for changing the refrigerant flow direction based upon which mode of operation is being used, as will be appreciated by those of skill in the art.

To cool (or, in the case of heat pump operation, heat) the refrigerant after it passes through the indoor heat exchanger 13, the air conditioning system 10 includes an outdoor unit 14 positioned outside of the building 12. The outdoor unit 14 includes a housing 15 and an outdoor heat exchanger 29 carried by the housing which illustratively includes coils 16 and metal fins 17 mounted thereon to improve thermal transfer. Of course, other suitable types of heat exchangers may also be used, as will be appreciated by those of skill in the art.

The housing 15 may have openings 19 therein to permit air flow, and the outdoor heat exchanger 29 is preferably positioned adjacent the openings for this reason. While the outdoor heat exchanger 29 is shown as being adjacent only a single side of the housing 15, it will be appreciated that the outdoor heat exchanger may extend around to other sides of the housing as well, which may similarly have openings 19 therein.

Moreover, various shapes of housings 15 are contemplated by the present invention, such as square housings, circular or rounded housings, etc. Further, in some embodiments, the housing 15 may have sides made of panels (e.g., metal panels), as illustratively shown, but in other embodiments the sides may resemble a "cage" made of relatively thick metal wires or rods. Numerous other housing 15 configurations will also be appreciated by those skilled in the art.

More particularly, the outdoor heat exchanger 29 is connected in fluid communication by tubing 18 with the indoor heat exchanger 13 for exchanging heat between the refrigerant and air outside the building 12. To this end, the air conditioning system 10 also includes a compressor 20 for circulating the refrigerant between the indoor heat exchanger 13 and the outdoor heat exchanger 29, and the outdoor unit 14 includes a fan 21 carried by the housing 15 for circulating outside air through the outdoor heat exchanger. The compressor 20 is illustratively shown as being located within in the outdoor unit 14, but it will be appreciated that the compressor may be located elsewhere in some embodiments.

In accordance with the invention, the air conditioning system 10 also includes a liquid washdown dispenser 22 carried by the housing 15 adjacent the outdoor heat exchanger 29. The liquid washdown dispenser 22 illustratively includes a plurality of nozzles 23 adjacent the outdoor heat exchanger 29 and, optionally, the fan 21 and/or other components of the outdoor unit 14. Tubing 24 connects the nozzles 23 to a liquid dispensing source 25, such as the fresh water supply line in the illustrated example, via a controller 26 which controls liquid flow to the nozzles. Of course, other liquid dispensing sources 25 may also be used, such as a tank for fresh water or other liquid suitable for washing down the outdoor unit 15 components. Such liquids may include anti-corrosive agents as well. A manual shutoff valve 27 may optionally be included in some embodiments to override the flow of liquid to the outdoor unit 14, if desired, as illustratively shown.

The controller 23 and liquid washdown dispenser 22 advantageously cooperate to remove salt or other unwanted material from the coils 16, fins 17 and/or fan 21 (and, optionally, other components) to reduce corrosion and/or premature component failure, and thus prolong the life of such components. Not only is the air conditioning system 10 thus well suited for use in environments where there is a high percentage of salts in the air (e.g., in coastal regions), but it may also be used for removing dirt, grass, and other debris which can build up on the coils 16, fins 17, and/or fan 21 which can reduce heat exchange efficiency and even cause damage to such components.

In accordance with one exemplary embodiment illustrated in FIG. 2, the controller 26 includes a valve 30 connecting the liquid washdown dispenser 22 to the liquid dispensing source 25, and a solenoid 31 for opening and closing the valve. The solenoid 31 is in turn connected to control circuitry 32 which determines when liquid is to be dispensed and supplies the requisite current to the solenoid for causing the value 30 to be opened. To this end, the control circuitry 32 may include a microprocessor, power amplifiers, etc., for example, as will be appreciated by those of skill in the art.

The control circuitry 32 may determine when liquid is to be dispensed based upon several different factors. For example, the controller 26 may also include a timer 33 for periodically causing the liquid flow to be turned on and off. That is, based upon the timer 33, the valve 30 may be opened for desired intervals at a desired frequency, such as one-minute intervals three times a day, for example. Thus, wash downs may advantageously be performed frequently enough to adequately reduce corrosion while not wasting liquid/fresh water. Of course, any frequency and/or duration of waterings may be used in accordance with the present invention depending upon the particular environment or equipment being used.

It should be noted that while the control circuitry 32 and timer 33 have been illustrated as separate components for clarity of illustration, they may well be implemented in a single device. In fact, in some embodiments the controller 26 could be a controller for a sprinkler system in which the liquid washdown dispenser 22 is connected as one zone of the sprinkler system, as will be understood by those of skill in the art. It will also be appreciated that various types of timing devices (e.g., mechanical, electronic, etc.) may be used for the timer 33.

Another factor which may be used for determining when to dispense liquid is whether the outdoor unit 14 is turned on. That is, the air conditioning system 10, and thus the outdoor unit 14, preferably cycles on and off as cooling/heating is required within the building 12. This determination is generally made by a thermostat (not shown) within the building 12 that measures when the inside air has exceeded or fallen below a desired temperature. The thermostat then causes the system 10 to be operational until the temperature reaches the desired temperature.

As such, in some embodiments the controller 26 may advantageously receive an input indicating whether the outdoor unit 14 is on or off. That is, when the outdoor unit 14 is in the on state, the fan 21 blows heated (or cooled, in the case of heat pump operation) air away from the outdoor unit 14. Accordingly, to avoid having the liquid sprayed outside of the outdoor unit 14 and onto the building 12, passersby, etc., the controller 26 may prohibit liquid flow to the liquid washdown dispenser 22 when the outdoor unit 14 is in the on state.

A method aspect of the invention is for retrofitting the outdoor unit 14. The method may include mounting a liquid washdown dispenser 22 in the housing 15 adjacent the outdoor heat exchanger 29, and connecting the liquid washdown dispenser 22 to the liquid dispensing source 25 for dispensing liquid to wash down the outdoor heat exchanger. In addition, the method may also include connecting the controller 26 to the liquid dispensing source 25 for controlling liquid flow to the liquid washdown dispenser 22. Other method aspects of the present invention will be apparent to those skilled in the art based upon the foregoing description and will therefore not be discussed further herein.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An air conditioning system comprising:

an indoor heat exchanger to be positioned within a building and comprising a refrigerant for exchanging heat with air inside the building;

an outdoor unit to be positioned outside of the building and comprising a housing and an outdoor heat exchanger carried by said housing, said outdoor heat exchanger being connected in fluid communication with said indoor heat exchanger for exchanging heat between the refrigerant and air outside the building, said outdoor unit being switchable between on and off states;

a compressor for circulating the refrigerant between said indoor heat exchanger and said outdoor heat exchanger;

a liquid washdown dispenser carried by said housing adjacent said outdoor heat exchanger, said liquid washdown dispenser being connected to a liquid dispensing source for dispensing liquid to wash down said outdoor heat exchanger; and a controller for controlling liquid flow to said liquid washdown dispenser, said controller prohibiting liquid flow to said liquid washdown dispenser when said outdoor unit is in the on state.

2. The air conditioning system of claim 1 wherein said controller comprises a timer for periodically causing the liquid flow to be turned on and off.

3. The air conditioning system of claim 2 wherein said controller further comprises:

a valve connecting said liquid washdown dispenser to the liquid dispensing source; and a solenoid connected between said timer and said valve.

4. The air conditioning system of claim 1 wherein said liquid washdown dispenser comprises:

a plurality of nozzles adjacent said outdoor heat exchanger; and tubing connecting said nozzles to the liquid dispensing source.

5. The air conditioning system of claim 1 wherein said outdoor unit further comprises a fan carried by said housing for circulating outside air through said outdoor heat exchanger; and wherein said liquid washdown dispenser also dispenses liquid to wash down said fan.

6. The air conditioning system of claim 1 wherein said housing has openings therein to permit air flow; and wherein said outdoor heat exchanger is positioned adjacent the openings.

7. An air conditioning system comprising:

an indoor heat exchanger to be positioned within a building and comprising a refrigerant for exchanging heat with air inside the building;

an outdoor unit to be positioned outside of the building and comprising a housing, an outdoor heat exchanger carried by said housing, and a fan carried by said housing for circulating outside air through said outdoor heat exchanger, said outdoor heat exchanger being connected in fluid communication with said indoor heat exchanger for exchanging heat between the refrigerant and air outside the building;

a compressor for circulating the refrigerant between said indoor heat exchanger and said outdoor heat exchanger;

a liquid washdown dispenser carried by said housing adjacent said outdoor heat exchanger and said fan, said liquid washdown dispenser being connected to a liquid dispensing source for dispensing liquid to wash down said outdoor heat exchanger and said fan; and a controller for controlling liquid flow to said liquid washdown dispenser.

8. The air conditioning system of claim 7 wherein said liquid washdown dispenser comprises:

a plurality of nozzles adjacent said outdoor heat exchanger and said fan; and tubing connecting said nozzles to the liquid dispensing source.

9. The air conditioning system of claim 7 wherein said outdoor unit is switchable between on and off states; and wherein said controller causes liquid flow to said liquid washdown dispenser when said outdoor unit is in the on state.

10. The air conditioning system of claim 7 wherein said controller comprises a timer for periodically causing the liquid flow to be turned on and off.

11. The air conditioning system of claim 10 wherein said controller further comprises:

a valve connecting said liquid washdown dispenser to the liquid dispensing source; and a solenoid connected between said timer and said valve.

12. A method for retrofitting an outdoor unit of an air conditioning system comprising a housing and an outdoor heat exchanger carried by the housing, the outdoor heat exchanger for exchanging heat between a refrigerant therein and air outside the building and being switchable between on and off states, the method comprising:

mounting a liquid washdown dispenser in the housing adjacent the outdoor heat exchanger;

connecting the liquid washdown dispenser to a liquid dispensing source for dispensing liquid to wash down the outdoor heat exchanger; and connecting a controller to the liquid dispensing source for controlling liquid flow to the liquid washdown dispenser and prohibiting liquid flow to the liquid washdown dispenser when the outdoor unit is in the on state.

13. The method of claim 12 wherein the controller comprises a timer for periodically causing the liquid flow to be turned on and off.

14. The method of claim 13 wherein connecting the controller to the liquid dispensing source comprises:

connecting a valve between the liquid washdown dispenser and the liquid dispensing source; and connecting a solenoid between the timer and the valve.

15. The method of claim 12 wherein the liquid washdown dispenser comprises:

a plurality of nozzles adjacent the outdoor heat exchanger; and tubing connecting the nozzles to the liquid dispensing source.

16. The method of claim 12 wherein the outdoor unit further comprises a fan carried by the housing for circulating outside air through the outdoor heat exchanger; and wherein the liquid washdown dispenser also dispenses liquid to wash down the fan.

17. A method for retrofitting an outdoor unit of an air conditioning system comprising a housing, an outdoor heat exchanger carried by the housing, and a fan carried by the housing for circulating outside air through the outdoor heat exchanger, the outdoor heat exchanger for exchanging heat between a refrigerant therein and air outside the building, the method comprising:

mounting a liquid washdown dispenser in the housing adjacent the outdoor heat exchanger and the fan;

connecting the liquid washdown dispenser to a liquid dispensing source for dispensing liquid to wash down the outdoor heat exchanger and the fan; and connecting a controller to the liquid dispensing source for controlling liquid flow to the liquid washdown dispenser.

18. The method of claim 17 wherein the controller comprises a timer for periodically causing the liquid flow to be turned on and off.

19. The method of claim 18 wherein connecting the controller to the liquid dispensing source comprises:

connecting a valve between the liquid washdown dispenser and the liquid dispensing source; and connecting a solenoid between the timer and the valve.

20. The method of claim 17 wherein the liquid washdown dispenser comprises:

a plurality of nozzles adjacent the outdoor heat exchanger and the fan; and tubing connecting the nozzles to the liquid dispensing source.

* * * * *